United States Patent [19]

Ekrud et al.

[11] 4,381,606

[45] May 3, 1983

[54] CHAIN SAW GUIDE BAR

[75] Inventors: Anders L. Ekrud, Sandviken; Glenn G. E. Pantzar, Arsunda, both of Sweden

[73] Assignee: Santrade Ltd., Lucerne, Switzerland

[21] Appl. No.: 242,309

[22] Filed: Mar. 10, 1981

[30] Foreign Application Priority Data

Mar. 14, 1980 [SE] Sweden ..... 8002016

[51] Int. Cl.[3] ..... B27B 17/00

[52] U.S. Cl. ..... 30/387

[58] Field of Search ..... 30/383, 384, 386, 387, 30/382, 385

[56] References Cited

U.S. PATENT DOCUMENTS 2,948,309 8/1960 Hoff ..... 30/387

4,259,783 4/1981 Scott-Jackson ..... 30/384

*Primary Examiner*—Jimmy C. Peters

*Attorney, Agent, or Firm*—Burns, Doane, Swecker & Mathis

[57] ABSTRACT

A saw guide bar comprising a main part and a nose part detachably fastened to the main part, the joints between the nose part and the main part being displaced relative to each other in the direction of chain travel.

11 Claims, 3 Drawing Figures

CHAIN SAW GUIDE BAR

BACKGROUND AND OBJECTS OF THE INVENTION

This invention relates to a chain saw guide bar provided with a detachable nose part.

In U.S. Pat. No. 3,762,047 a saw guide bar with detachable nose part is disclosed which represents a type being presently marketed. The patent discloses a nose part which is fastened to a main part of the saw guide bar by means of rivets. In this connection, the nose part is provided with a central, projecting part which fits into a corresponding recess in the main part of the saw guide bar. This recess causes a drastic weakening of the main part of the saw guide bar and may lead to fracture, whereby the whole saw guide bar has to be replaced. Further, the known saw guide bar is provided with joints formed by the opposing edges of the nose part and main part. This arrangement causes at least three drawbacks. Firstly, it is difficult to get enough stiffness in the joint. Secondly, the wear of the chain will be great when the chain hits against the joints positioned side-by-side between the two side plates. Thirdly, the wear of the edge of the saw guide bar will also be great, due to the hits of the saw chain against the edge.

This invention is intended to remove the mentioned drawbacks which are connected with known types of saw guide bars provided with a detachable nose part.

In accordance with the invention, the joints between the nose part and main part are displaced from one another in the direction of chain travel as regards both the horizontal and vertical center planes.

BRIEF SUMMARY OF THE INVENTION

These objects are achieved by the present invention which involves a guide bar for chain saws. The guide bar comprises a main part and a nose part detachably fastened to the main part. The guide bar is provided with a slot along its periphery for receiving a saw chain. Opposing edges of the main part and nose part form joints. Each joint on one side of a vertical center plane is displaced in the direction of chain travel relative to a laterally adjacent joint on the other side of such vertical center plane. The main part includes at least one projecting part received in at least one recess in the nose part.

Preferably, each joint on one side of a horizontal center plane is displaced in the direction of chain travel relative to a vertically spaced joint on the other side of the horizontal center plane.

THE DRAWINGS

An embodiment of the invention shall be more closely described in connection with the accompanying drawings in which.

DETAILED DESCRIPTION OF A PREFERRED EMBODIMENT OF THE INVENTION

Figure 1:
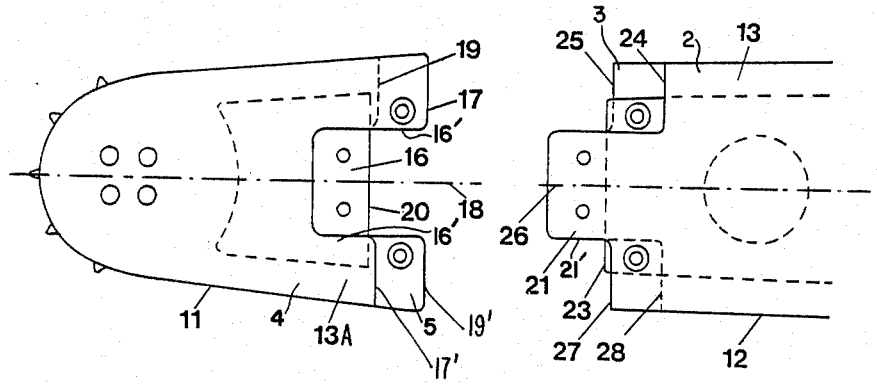
FIG. 1 depicts in exploded side view, a nose part and the closest part of the main part of the guide bar.
Figure 2:
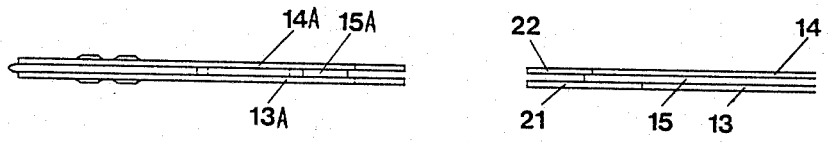
FIG. 2 depicts the same parts as in FIG. 1 but seen from above (or from below)

In FIGS. 1 and 2 are disclosed, in exploded view, a nose part 11 provided with a nose sprocket wheel, and the closest portion 12 of the main part of the saw guide bar. Each component 11, 12 of the saw guide bar comprises at least two sides plates 13, 13A, 14, 14A and at least one intermediate plate 15, 15A of steel or another material. The nose part 11 may be made of a more wear-resisting material than the remaining part of the guide bar. The three plates 13, 14, 15, and 13A, 14A and 15A are joined in a suitable way, for instance by means of spot welding, rivets, screws or similar things. In the shown case, the side plates 13, 14 of the guide bar include portions 2, 3 project beyond the intermediate plate 15, and the side plates 13A, 14A include portions 4, 5 project beyond the intermediate plate 15A, in order to function as slot-forming walls which form a slot in which the chain shall run.

Preferably, rectangular recesses 16 are made in the two side plates 13A, 14A on each side of the intermediate plate 15A in the exchangeable nose part 11. Further, the outer or extension parts of the side plates which form the recess 16 therebetween project beyond the intermediate plate 15A. In this connection, the edge 17 of the extension part of a side plate 13A on one side of a horizontal plane through a center line 18 of the nose part (i.e., a plane disposed perpendicular to the side plates 13, 14, 13A, 14A and containing the longitudinal axis of the guide bar) is disposed beyond the intermediate plate 15A much more than the edge 19 on the laterally adjacent side plate 14A. Just the opposite arrangement exists on the other side of the horizontal plane (i.e., below the plane) wherein edge 19′ projects beyond edge 17′. It ought to be observed that it is not necessary that the edges 17, 19 or 17′, 19′ beyond the edge 20 of the intermediate plate 15A. The important thing is that the edges 17, 19 or 17′, 19′ are displaced in relation to each other. It is, however, an advantage if at least the edge of one side plate projects outside the edge of the intermediate plate 15A.

That portion 12 of the main part of the saw guide bar being positioned closest to the nose part 11 is so formed that it shall fit with the nose part. In this connection, the middle parts 21, 22 of the side plates 13, 14 in the main part of the guide bar project beyond the edge 23 of the intermediate plate 15 in order to fit into the recesses 16 in the side plates of the nose part 11. The middle parts 21, 22 have a rectangular form (as in the drawing) in those cases when the recesses 16 are rectangularly formed. Each projecting part 21 includes longitudinal edges 21′ which are disposed on opposite sides of the horizontal center plane and which engage corresponding longitudinal edges 16′ of the recess 16. The edges 16′ comprise a part of the respective plate 13A or 14A and thus are of integral one-piece construction with the slot-forming walls of that plate. Further, according to the described and illustrated embodiment, the two outer edges 24, 25 of the two side plates on one side of a horizontal center plane through the center line 26 of the main part are positioned behind (i.e., terminate short of) the edge 23 of the intermediate plate 15. The same is true of the edges 27, 28 on the other side of the horizontal plane. In this connection, the two edges 24, 25 on one side of the horizontal plane of the main part are mutually displaced so that the edge 25 of the side plate 14 is positioned beyond the edge 24 of the side plate 13. On the other side of the horizontal plane, an opposite arrangement exists whereby the edge 27 of the side plate 13 is positioned beyond the edge 28 of the side plate 14. In this connection, the displacement of one edge outside the other edge is the same on both sides of the horizontal plane of the main part and as great as the displacement between the edges of the side plates in the nose part 11 on each side of its horizontal center plane. Further, the relationship between the extension of the edges of the side plates on the upper and lower parts of the nose part is opposite the relationship that applies for the extension of the edges of the side plates on the upper and lower parts of the main part (e.g., the short edge 19 of the nose part faces the extended edge 25 of the main part), whereby the nose part and main part shall fit into each other.

Thus it can be stated that the joints are displaced from one another in the direction of chain travel on opposite sides of the horizontal and vertical center planes. That is, the joint 24, 17 on one side of the vertical center plane (i.e., a plane disposed parallel to the side plates 13, 14, 13A, 14A and containing the longitudinal axis of the guide bar) is displaced longitudinally relative the laterally adjacent joint 19, 25 on the other side of such plane; the joint 17, 24 is spaced longitudinally relative to the vertically adjacent joint 17', 27 on the other side of the horizontal center plane.

When joining the nose part and the main part, the projecting middle parts 21, 22 of the side plates of the main part of the guide bar are brought into the recesses 16 in the nose part. Thereafter, the parts 21, 22 are joined with the intermediate plate 15, for instance by means of rivets 29. Moreover, the side plates are joined with the intermediate plate at the connecting end parts of nose part and main part. In this connection, fastening elements, preferably rivets 30, 31 are each positioned between the slot for the saw chain and the center line of the saw guide bar in order not to disturb the movement of the saw chain in the slot. In those cases when rivets or screws are used as fastening elements, the plates are provided with suitable holes going through the plates for reception of those fastening elements.

Figure 3:
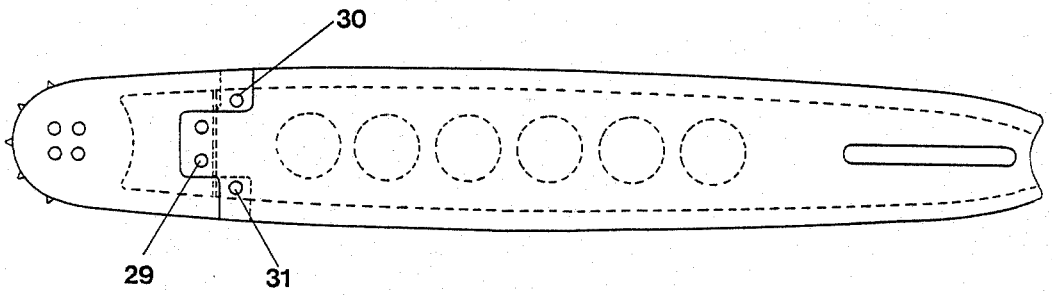
FIG. 3 depicts the parts of FIG. 1 interconnected to form a saw guide bar.

In FIG. 3, round holes have been depicted by short distances. It could be suitable when the guide bar exceeds a certain length in order to reduce its weight to make recesses in the guide bar for instance in the form of those round holes.

Further, in the drawing the nose part of the saw guide bar is provided with a nose sprocket wheel. The invention will probably be used foremost for such type of saw guide bars but may also be used for saw guide bars having an exchangeable nose part without nose sprocket wheel.

The described saw guide bar has an advantageous construction. Firstly, the joints between the side plates in nose part and main part are displaced in relation to each other, e.g., the joint 24, 17 is displaced relative to the joint 25, 19 in the direction of chain travel. This leads to a butt and stable joint in zig-zag form that prevents appearing bending stresses to act on a straight line. Rather, the bending stresses are divided between several joint surfaces with different positions for side and intermediate plates. Further, by having displaced joints the wear is reduced on both chain and saw guide bar. Due to the fact that the chain only passes one joint at a time, it will more softly pass the joint part with the result that not only the wear is reduced but also vibrations and jerks in the saw itself are reduced. Therefore, the displaced joints also have a security-increasing effect.

Secondly, the main part is provided with projecting parts 21, 22 which shall fit into corresponding recesses 16 in the nose part. That means that the zig-zag effect previously mentioned is increased. Further, this feature means that the risk of fracture of the main part, which is the largest and most expensive part of the guide bar, is very small since strength-reducing recesses for cooperation with the nose part have not been made in the main part of the saw guide bar.

Thirdly, the construction makes it possible to put the uniting rivets near the chain slot, whereby the stiffness of the unit is increased at the same time as the fit will be better between the nose part and the main part.

Fourthly, this construction makes it possible to put the joint between the side plates outside that zone where the chain links are unloaded from the nose sprocket wheel to the glide surfaces of the guide bar and where the wear is greatest. Accordingly, the further wear can be reduced by this fact.

The invention is not limited to motor saw guide bars comprising joined plates but the invention can also be used for guide bars having both nose and main parts made of solid material. In this connection, the recesses 16 are preferably milled-out from the nose part, and besides that, the outer parts of the nose part are so formed that the eyes become displaced in relation to each other. The main part is also so formed that the outer parts resting against the nose part are provided with edges which are displaced relative to each other. In this connection the central projecting part of the main part may either be an integrated part of the main part or comprise plates fastened to the main part.

The material in the described embodiments of the saw guide bar is preferably steel but other known materials can also be used.

Although the invention has been described in connection with a preferred embodiment thereof, it will be appreciated by those skilled in the art that additions, modifications, substitutions, and deletions not specifically described, may be made without departing from the spirit or scope of the invention as defined in the appended claims.

What is claimed is:

1. Saw guide bar for chain saws comprising a main part and a nose part detachably fastened to the main part, said main part including slot-forming walls on opposite sides of a vertical center plane to form a first slot along its periphery for receiving a saw chain, said nose part including slot-forming walls on opposite sides of the vertical center plane to form a second slot along its periphery which is aligned with said first slot for receiving the saw chain, opposing edges of said slot-forming walls of said main part and said nose part forming joints, each joint on one side of said vertical center plane being displaced in the direction of chain travel relative to a laterally adjacent joint on the other side of said vertical center plane, said main part including at least one projecting part received in at least one recess in the nose part said projecting part having longitudinal edges disposed on opposite sides of a horizontal center plane and which engage corresponding longitudinal edges of said recess, said longitudinal edges of said recess being of integral, one-piece construction with a slot-forming wall of said nose part.

2. Saw guide bar according to claim 1, wherein each joint on one side of a horizontal center plane being displaced in the direction of chain travel relative to a vertically spaced joint on the other side of the horizontal center plane.

3. Saw guide bar according to claim 2, wherein the nose part and the main part of the saw guide bar each comprise at least an intermediate plate and two side plates which project beyond the intermediate plate to form said slot, said recess being defined by vertically spaced extension portions of said side plates of said nose which project beyond the intermediate plate of said nose part toward said main part.

4. Saw guide bar according to claim 3, characterized in that the extension portion of one side plate on one side of a horizontal center plane of the nose part extends beyond the laterally adjacent side plate in the longitudinal direction of the guide bar, and an opposite arrangement exists on the other side of the horizontal center plane.

5. Saw guide bar according to claim 3 or 4, wherein the projecting part of the main part is positioned centrally relative to a horizontal center plane and is formed by the two side plates of the main part.

6. Saw guide bar according to claim 5, wherein one side plate on one side of the horizontal center plane of the main part extends beyond the laterally adjacent side plate in the longitudinal direction of the guide bar, and an opposite arrangement exists on the other side of the horizontal center plane.

7. Saw guide bar according to claim 6, wherein each side plate of the main part has a projecting part received in respective recesses in the side plates of said nose part, said recesses being separated by the intermediate plate of said nose part, and said projecting parts extending past the outer end of said last-named intermediate plate.

8. Saw guide bar according to claim 7, wherein said outer edge of said last-named intermediate plate terminates short of the most extended edge of the exterior portions of said nose part.

9. Saw guide bar according to claim 2, wherein both the nose part and main part are made of solid material.

10. Saw guide bar according to claim 2, wherein the nose part and the main part are fastened to each other by means of fastening elements including fastening elements holding the side plates of the nose part against the side plates of the main part and positioned between the slot for the saw chain and the horizontal center plane.

11. Saw guide bar according to claim 2, wherein the nose part is provided with a rotatably journaled nose sprocket wheel.

* * * * *